US009874191B2

(12) United States Patent
Xiao et al.

(10) Patent No.: US 9,874,191 B2
(45) Date of Patent: Jan. 23, 2018

(54) METHOD AND SYSTEM FOR ASSISTING ENGINE START WITH A SUPERCHARGER

(71) Applicant: Ford Global Technologies, LLC, Dearborn, MI (US)

(72) Inventors: Baitao Xiao, Canton, MI (US); Hamid-Reza Ossareh, Ann Arbor, MI (US); Adam Nathan Banker, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 253 days.

(21) Appl. No.: 14/804,624

(22) Filed: Jul. 21, 2015

(65) Prior Publication Data

US 2017/0022954 A1 Jan. 26, 2017

(51) Int. Cl.
*F02N 11/08* (2006.01)
*F02B 33/40* (2006.01)

(52) U.S. Cl.
CPC ..... *F02N 11/0829* (2013.01); *F02B 33/40* (2013.01)

(58) Field of Classification Search
CPC ..... F02B 33/40; F02N 11/0829
See application file for complete search history.

(56) References Cited

U.S. PATENT DOCUMENTS

| | | | | |
|---|---|---|---|---|
| 4,315,400 | A | 2/1982 | Cole et al. | |
| 4,667,645 | A | 5/1987 | Gluckman | |
| 4,884,744 | A | 12/1989 | Padgaonkar | |
| 6,209,500 | B1 | 4/2001 | Tallio et al. | |
| 6,938,419 | B2 * | 9/2005 | Okuyama | F02B 37/10 123/565 |
| 8,583,351 | B2 | 11/2013 | Uhrich et al. | |
| 2006/0180130 | A1 * | 8/2006 | St. James | F02B 33/40 123/559.1 |
| 2013/0276765 | A1 | 10/2013 | Moffat et al. | |
| 2016/0348620 | A1 * | 12/2016 | Ramseyer | F02B 33/40 |

FOREIGN PATENT DOCUMENTS

JP 60013931 A * 1/1985 ..... F02D 9/02

* cited by examiner

*Primary Examiner* — Mary A Davis
(74) *Attorney, Agent, or Firm* — Julia Voutyras; McCoy Russell LLP

(57) ABSTRACT

Methods and systems are provided for reliable starting an engine during cold start. In one example, a method may include in response to an engine start request, warming up an intake manifold by compressing intake air via an electric supercharger, and adjusting an intake manifold pressure before starting a first combustion of the engine.

19 Claims, 4 Drawing Sheets

METHOD AND SYSTEM FOR ASSISTING ENGINE START WITH A SUPERCHARGER

FIELD

The present description relates generally to methods for warming up an intake manifold of a vehicle engine to facilitate cold start.

BACKGROUND/SUMMARY

Internal combustion engines are frequently equipped with turbochargers. A turbocharger is driven by the exhaust flow of the internal combustion engine, and may compress the intake airflow into the engine in order to achieve more power. Multi-stage intake charging systems with series stages of turbocharger or electric supercharger (ES) systems are adopted to improve the boost response of turbocharged engines. Compared to the turbocharger, the ES has the advantage of delivering boost pressure faster in a shorter response time. For example, an ES typically has a response time (idle to 100% duty cycle) in the 130-200 ms range, compared to 1-2 seconds for a turbocharger.

Ethanol is widely used as a renewable fuel worldwide. However, due to the ultra-low volatility of ethanol at around freezing temperature, vehicles using a high percentage of ethanol as fuel may be difficult to start in cold weather. During vehicle cold start, fuel injected into the engine cylinder may stay in the liquid form and fail to form a combustible air/fuel mixture with intake air. As such, a first combustion of the engine may not be reliably initiated, which may impair drivability, fuel consumption, and exhaust gas emissions.

One example approach to address the issue is shown by Gluckman in U.S. Pat. No. 4,667,645. Therein, during cold start, an intake manifold is warmed up by an intake manifold heater before injecting fuel into an engine combustion chamber.

However, the inventors herein have recognized potential issues with such a system. As one example, the intake manifold heater may take a relatively long time to warm up the intake manifold to a desired temperature. As a result, engine start may be delayed and vehicle drivability may be affected. Moreover, because of thermal expansion of air in the intake manifold, manifold pressure may change during the warmup process. Pressure in the intake manifold may change in response to the ambient temperature and the desired manifold temperature. Thus, intake manifold pressure may vary from one engine start to another and further affect vehicle drivability.

In one example, the issues described above may be addressed by a method for starting an engine, comprising: in response to an engine start request, operating a supercharger to warm up an intake manifold; and adjusting an intake manifold pressure before starting a first combustion of the engine. In this way, the engine may be reliably and quickly started during cold start.

As one example, during engine cold start, an ES is operated to compress intake air in response to an engine start request. The intake manifold may be warmed up by the compressed air. When temperature of the intake manifold reaches a predetermined value, intake manifold pressure is adjusted to a desired level for a first combustion. Temperature of fuel injected into the cylinder may be increased when passing through the warmed up intake manifold. As such, fuel injected during engine cold start may be warmed up without extra heating equipment. Moreover, due to the fast response and high efficiency of ES, engine start time may be shortened. Further, by adjusting intake manifold pressure before initiating the first combustion, engine operating conditions for the first combustion may be accurately controlled.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
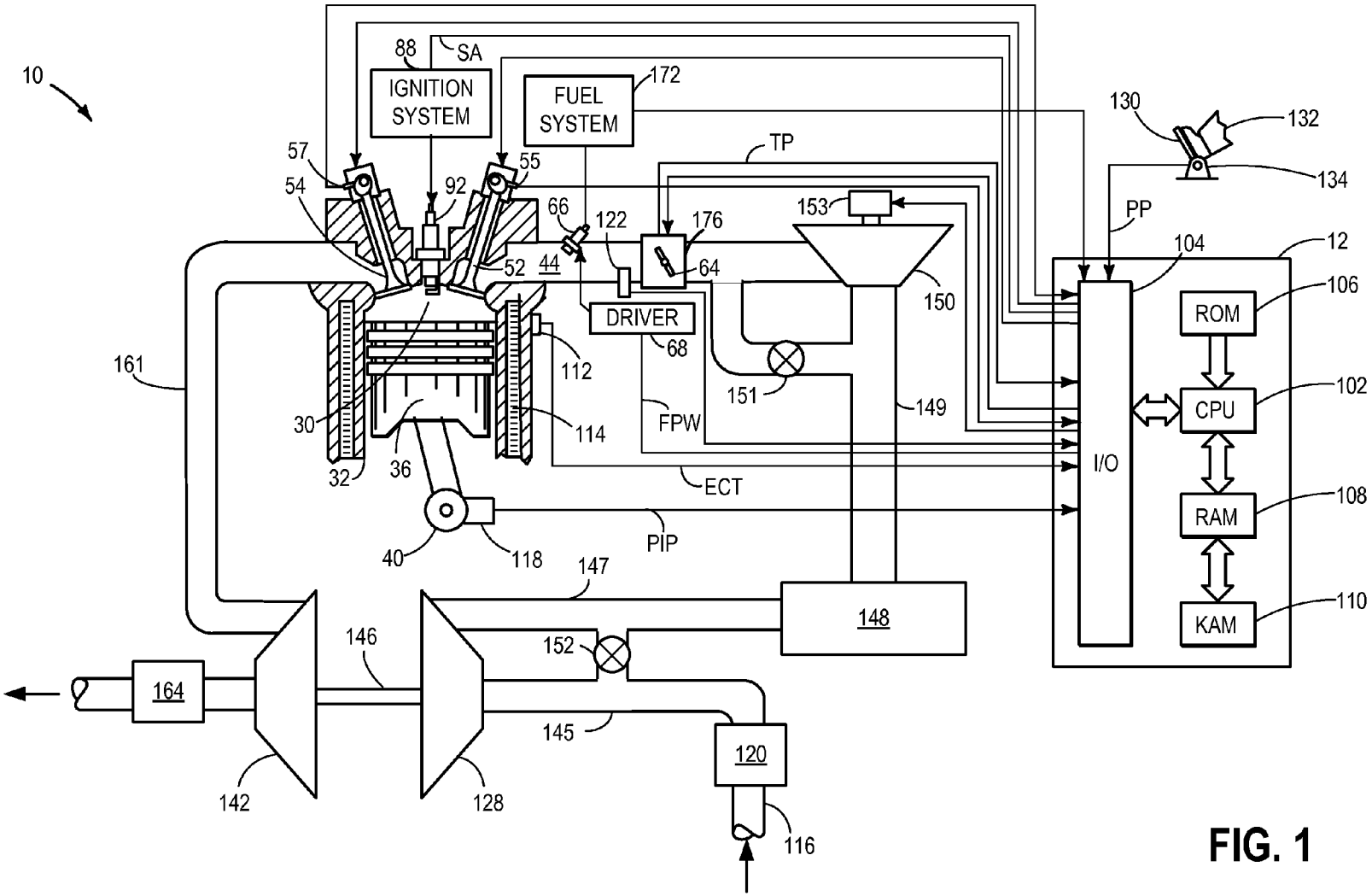
FIG. 1 shows a schematic depiction of an example engine system.
Figure 2:
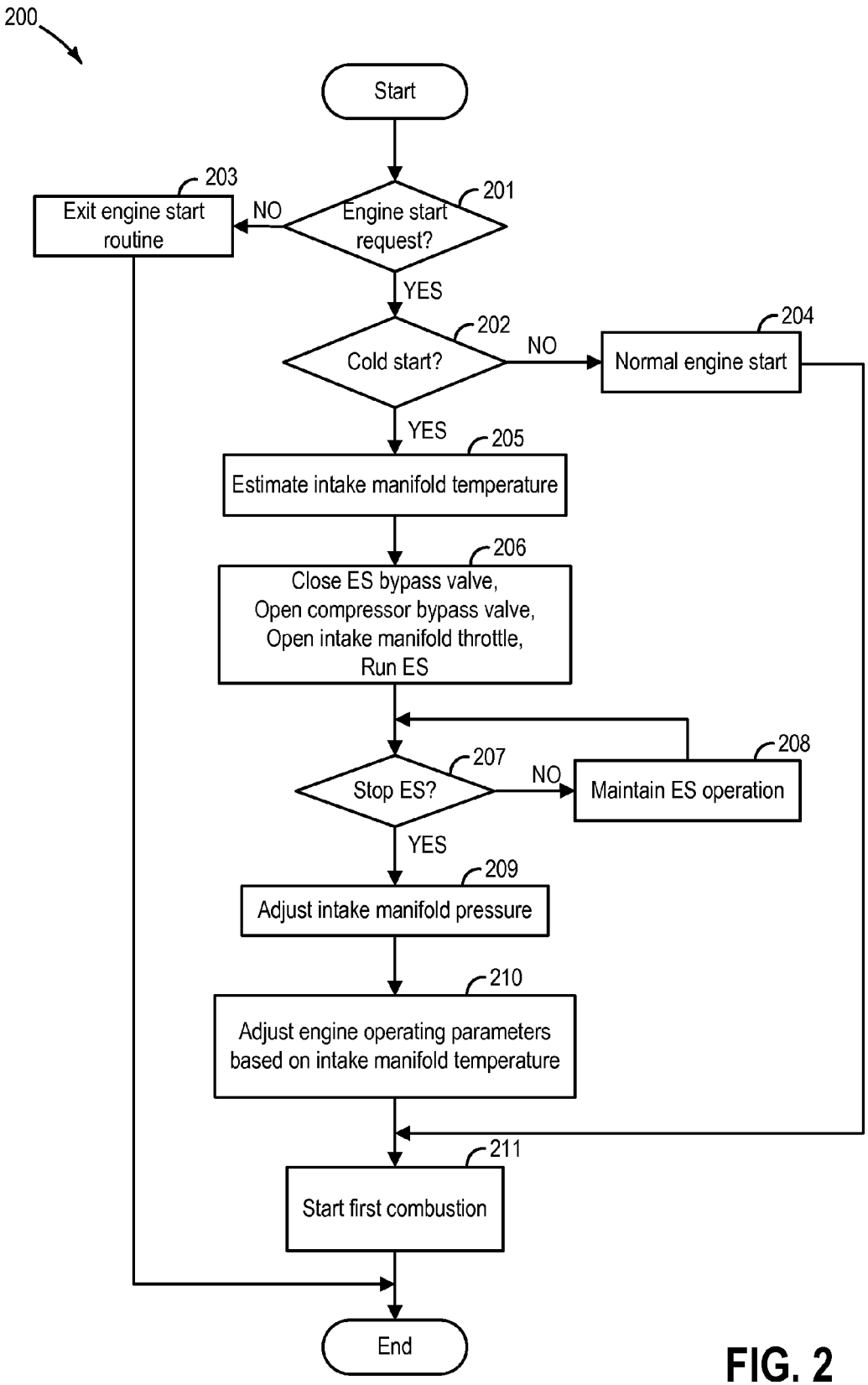
FIG. 2 shows a flow chart of an example method of starting an engine system.
Figure 3:
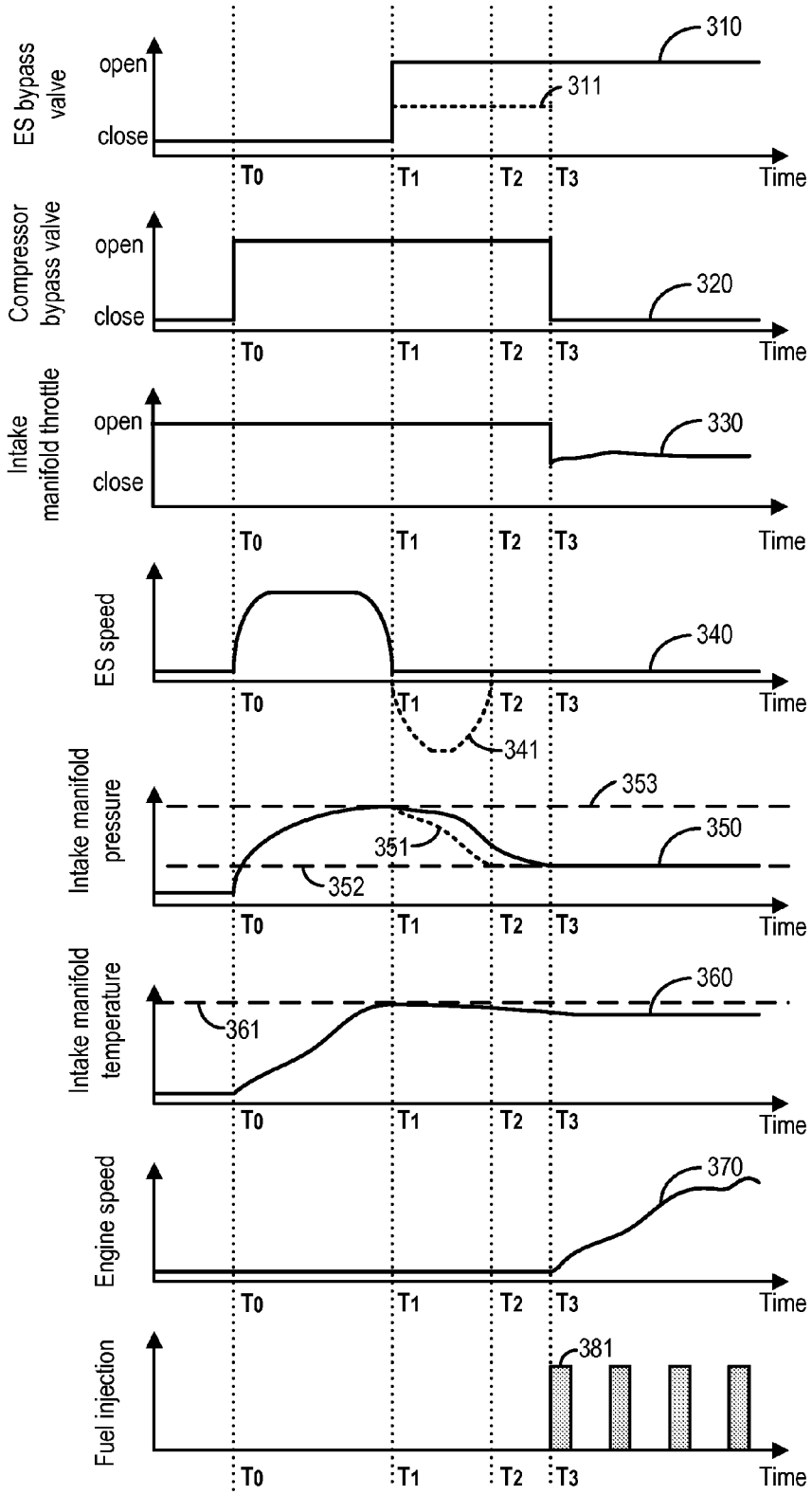
FIG. 3 shows operations of various actuators during engine cold start and engine parameters in response to the operations over time.
Figure 4:
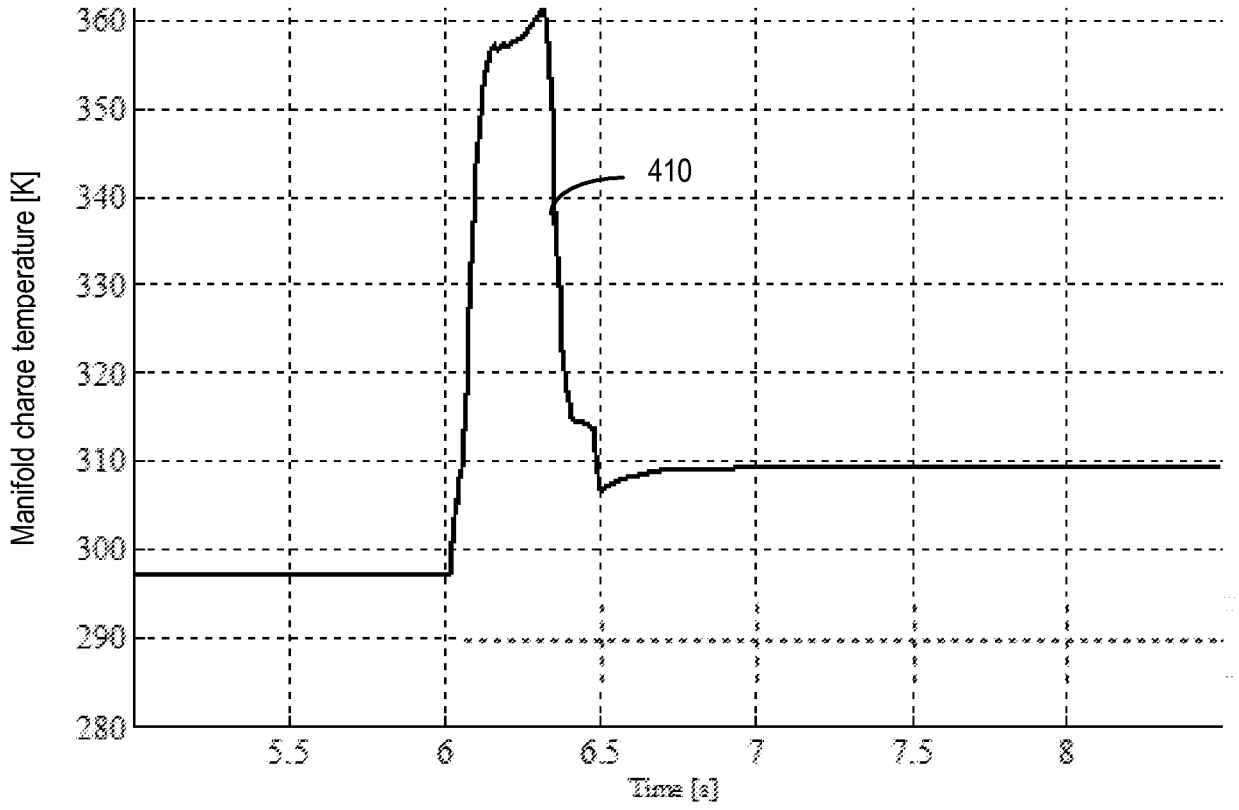
FIG. 4 demonstrates an example change of intake manifold charge temperature when operating an electric supercharger.

The following description relates to methods for starting an engine. FIG. 1 shows a schematic depiction of an example engine system with a multi-stage intake charging system. The multi-stage intake charging system comprises a turbocharger and an electric supercharger. FIG. 2 shows a flow chart of an example method of starting the engine system shown in FIG. 1. During cold start, the method operates the electric supercharger and various actuators to warm up an intake manifold with compressed air. As shown in FIG. 4, the electric supercharger may quickly increase the intake manifold charge temperature in a short response time. FIG. 3 illustrates the operations of various actuators and the change of engine operating parameters according to the method shown in FIG. 2.

FIG. 1 depicts a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Crankshaft 40 may also be coupled to a starter motor via a flywheel to enable a starting operation of engine 10. Further, a crankshaft torque sensor may be coupled to crankshaft 40 for monitoring engine torque.

Combustion chamber 30 may receive intake air from intake manifold 44. Intake manifold 44 and exhaust passage 161 can selectively communicate with combustion chamber 30 via respective intake valve 52 and exhaust valve 54. In some embodiments, combustion chamber 30 may include two or more intake valves and/or two more exhaust valves. In this example, intake valve 52 and exhaust valve 54 may be controlled by cam actuation via one or more cams and may utilize one or more of cam profile switching (CPS), variable cam timing (VCT), variable valve timing (VVT), and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

In some embodiments, each cylinder of engine 10 may be configured with one or more fuel injectors for providing fuel thereto. As a non-limiting example, cylinder 30 is shown including a fuel injector 66, which is supplied fuel from fuel system 172. Fuel injector 66 may be a port injector providing fuel into the intake port upstream of cylinder 30. The amount of injected fuel may be in proportion to the pulse width of signal FPW received from controller 12 via electronic driver 68.

Continuing with FIG. 1, intake manifold throttle 176 coupled to intake manifold 44 has a throttle plate 64. In this particular example, the position of throttle plate 64 may be varied by controller 12 via a signal provided to an electric motor or actuator included with throttle 176, a configuration that is commonly referred to as electronic throttle control (ETC). In this manner, throttle 176 may be operated to vary the intake air provided to combustion chamber 30 among other engine cylinders. The position of throttle plate 64 may be provided to controller 12 by throttle position signal TP.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Ambient air flow may enter engine 10 through intake passage 116. An air filter 120 may be arranged in intake passage 116 to remove solid particulate matter from intake air. Downstream of air filter 120, ambient air flowing through passage 145 is compressed by compressor 128 and then enters passage 147. Compressor 128 is at least partially driven by a turbine 142 coupled in an exhaust system of the engine via a shaft 146. Alternatively, intake air in passage 145 may bypass compressor 128 via a compressor bypass valve 152 coupled between the input and output of compressor 128. Intake air in passage 147 may be cooled by a charge air cooler 148 before entering an input of an electric supercharger (ES) 150 through passage 149. ES 150 may be positioned downstream of charge air cooler 148 and upstream of the intake manifold throttle 176, wherein ES 150 may be an electrical supercharger at least partially driven by an electric machine 153 (e.g., a motor). Controller 12 may communicate with electric machine 153 to control the speed and the direction of ES 150. When intake throttle 176 is open, operating ES 150 in a forward direction compresses intake air into the intake manifold, and operating ES 150 in a reversed direction decompresses the air in the intake manifold. ES 150 may be bypassed by a supercharger bypass valve 151 coupled between the input and output of ES 150 (e.g., bypass valve 151 may be positioned in a bypass passage coupling the intake passage upstream of ES 150 to the intake passage downstream of ES 150). Compressor bypass valve 152 and supercharger bypass valve 151 may each include a valve actuator. The valve actuators are electrically connected to controller 12. The valve actuators controls the opening of the valves based on signals received from controller 12. The valve actuators may be electric, pneumatic, or hydraulic actuators. Controller 12 may control compressor 128 and ES 150 individually or cooperatively to provide boost to the engine depending on operating conditions. As one example, during engine operation with relatively low exhaust energy (e.g., during a tip-in following idle operation), intake air may be compressed by both compressor 128 and ES 150 to provide additional compression to meet the tip-in torque request. In other examples, during engine operation with relatively high exhaust energy (e.g., during high load conditions), ES 150 may be inactivated and/or bypass valve 151 opened to avoid overboosting the engine. A sensor 122 may be coupled to the intake manifold. Sensor 122 may be a pressure sensor measuring the intake manifold pressure. Sensor 122 may be a temperature sensor for measuring the intake manifold charge temperature.

After combustion, combustion chamber 30 may exhaust combustion gases to exhaust passage 161. The exhaust gases drives turbine 142 coupled to exhaust passage 161. Emission control device 164 is shown arranged downstream of turbine 142. Emission control device 164 may be a three way catalyst (TWC), configured to reduce NOx and oxidize CO and unburnt hydrocarbons. In some embodiments, device 142 may be a NOx trap, various other emission control devices, or combinations thereof.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including engine coolant temperature (ECT) from temperature sensor 112 coupled to cooling sleeve 114; a profile ignition pickup signal (PIP) from Hall effect sensor 118 (or other type) coupled to crankshaft 40; a cylinder torque from the crankshaft torque sensor coupled to crankshaft 40; and throttle position (TP) from a throttle position sensor. Engine speed signal, RPM, may be generated by controller 12 from signal PIP. Controller 12 also may employ the various actuators of FIG. 1 to adjust engine operation based on the received signals and instructions stored on a memory of the controller.

Storage medium read-only memory 106 can be programmed with computer readable data representing non-transitory instructions executable by processor 102 for performing the methods described below as well as other variants that are anticipated but not specifically listed.

As described above, FIG. 1 shows only one cylinder of a multi-cylinder engine, and each cylinder may similarly include its own set of intake/exhaust valves, fuel injector, spark plug, etc.

Turning to FIG. 2, an example method of starting an engine is shown in method 200. If the engine cold start conditions are not met, method 200 may start the engine normally by cranking the engine and initiate a first combustion immediately in response to an engine start request. If engine cold start conditions are met, method 200 may postpone the first combustion by operating an ES (such as ES 150 of FIG. 1) and warming up an intake manifold of an engine with compressed air. The intake manifold pressure may also be adjusted by operating the ES bypass valve and the ES to enable fast and reliable engine start.

Instructions for carrying out method 200 and the rest of the methods included herein may be executed by a controller based on instructions stored on a memory of the controller and in conjunction with signals received from sensors of the engine system, such as the sensors described above with reference to FIG. 1. The controller may employ an electric machine, valve actuators, and throttle actuators (e.g., electric machine 153, valve actuators in compressor bypass valve 152 and supercharger bypass valve 151, throttle actuator in throttle valve 176 in FIG. 1) of the engine system to start an engine, according to the methods described below.

At 201, method 200 determines if an engine start request is present. As an example, the engine start request may be sent by a vehicle operator. As another example, the engine start request may be sent by vehicle controller. If an engine start is requested, method 200 moves to step 202 to start the engine. Otherwise, at step 203, method 200 exits the engine start routine.

At 202, method 200 determines whether the engine is under cold start. For example, engine cold start may be determined based on coolant temperature or cylinder temperature. If the coolant temperature or cylinder temperature is lower than a predetermined threshold, method 200 determines that the engine is under cold start. Alternatively, engine cold start may be determined based on ambient temperature and the duration since last engine operation. If the ambient temperature is lower than a predetermined threshold and the engine has not been operated for a period longer than a predetermined duration, engine cold start may be determined. As another example, engine cold start may be determined based on intake manifold temperature. The intake manifold temperature may be measured by a temperature sensor coupled to the intake manifold (such as sensor 122 in FIG. 1). In response to engine cold start, method 200 moves to step 205, wherein the controller estimates the intake manifold temperature. If the engine is not under cold start, method 200 moves to step 204, wherein normal engine start routine is initiated. The normal engine start routine may comprise closing the compressor bypass valve and use predetermined engine operation parameters for the first combustion. In normal engine start, a starter motor cranks the engine in response to an engine start request, and fuel injection and spark ignition occur in a designated cylinder immediately upon determining the position of the engine.

At step 205, method 200 estimates a temperature of the engine intake manifold. The intake manifold temperature may be estimated based on coolant temperature or cylinder temperature. Further, the intake manifold temperature may be directly measured by a temperature sensor coupled to the intake manifold.

At step 206, method 200 closes an ES bypass valve (such as valve 151 in FIG. 1), opens a compressor bypass valve (such as valve 152 in FIG. 1), and starts running the ES. In one example, the ES may be activated by operating a motor coupled to the ES (such as electric machine 153 of FIG. 1). The ES bypass valve is fully closed so that there is little or no air flow through the valve. Method 200 also opens an intake manifold throttle (such as intake manifold throttle 176 in FIG. 1) to ensure compressed air may enter into the intake manifold (such as intake manifold 44 in FIG. 1). By closing the ES bypass valve and opening the compressor bypass valve, the ES may draw air from an engine intake passage (such as intake passage 116 in FIG. 1), and retain the compressed air in the intake manifold. Heat may be quickly generated in the compressed air. Based on the first law of thermodynamics, heat generated by compression can be calculated using the following equation:

$$T_{comp_out} = T_{inlet}\left(1 + \frac{1}{\eta_{comp}}\left(\left(\frac{P_{desired}}{P_{inlet}}\right)^{\frac{\gamma-1}{\gamma}} - 1\right)\right) \quad \text{(equation 1)}$$

Wherein $\eta_{comp}$ is the isentropic efficiency of the compressor, $\gamma$ is the specific heat ratio of air, P is pressure and T is temperature. As such, heat from the compressed air may be used to pre-heat the intake manifold via thermal conduction.

Due to the fast response time and the high efficiency of the ES, the temperature of the compressed air may rise quickly for warming up the intake manifold. FIG. 4 shows an example change in the manifold charge temperature by operating an ES, wherein a 5 KW ES can increase manifold charge temperature (illustrated by curve 410 of FIG. 4) by 60° C. within 1 second.

Returning to FIG. 2, at 207, method 200 determines whether to stop running the ES. As an example, the ES may be stopped after operating for a predetermined time period. As another example, the ES may be stopped after operating for a duration determined by a lookup table. The lookup table may be constructed based on engine temperature. Further, the lookup table may be constructed based on both engine temperature and parameters of the ES. The parameters may include peak speed or peak air flow rate of the ES. As yet another example, the ES may be stopped when the intake manifold temperature is higher than a predetermined threshold. In some examples, the threshold intake manifold temperature may be based on fuel volatility, such that the threshold may be increased as fuel volatility decreases. The intake manifold temperature may be measured by a temperature sensor coupled upstream of the intake manifold throttle (such as sensor 122 in FIG. 1). The ES may alternatively be stopped when the intake manifold pressure is higher than a predetermined threshold. If method 200 determines not to stop the ES, the method moves to step 208 to maintain ES operation. If method 200 determines to stop the ES, the method moves to step 209.

At 209, intake manifold pressure is adjusted to a target pressure value suitable for a first combustion. As an example, the target pressure value may be ambient pressure. As another example, the target pressure value may be determined by the controller based on engine operating conditions. In one embodiment, the ES bypass valve is opened to release compressed air retained downstream of the ES. The opening of the bypass valve may be controlled based on the pressure difference across the ES bypass valve and the target pressure value. In another embodiment, the ES is operated in a reverse direction to decompress the retained air in the intake manifold. By operating the ES in a reverse direction, the target pressure value may be quickly obtained, thus faster engine start may be achieved. While the ES is operating in a reverse direction, the ES bypass valve may optionally be opened to facilitate adjusting the intake manifold pressure.

At 210, once the intake manifold pressure reaches the target pressure level, engine operating parameters may be adjusted based on intake manifold temperature. Alternatively, engine operating parameters may be adjusted based on a change of intake manifold temperature. The engine operating parameters may comprise an amount of injected fuel, a fuel injection timing in the engine cycle, a cylinder number to be fueled for the first combustion, and/or a spark timing. In an example, the amount of injected fuel may be increased with decreased intake manifold temperature. As another example, spark timing may be less retarded at a relatively low intake manifold temperature comparing to a relative high intake manifold temperature.

At 211, the first combustion is started based on the determined engine operating parameters. The controller may decrease the opening of the intake manifold throttle to control the intake air flow rate and start cranking the engine. In the cylinder identified for the first combustion, fuel is injected into the combustion chamber for the first combustion. Since the intake manifold is preheated when the engine is under cold start, fuel injected into the cylinder may be warmed up via the preheated intake manifold. Thus, method 200 ensures that the fuel entered into the combustion chamber is in liquid form, and the first combustion may be reliably initiated.

FIG. 3 shows operations of the ES bypass valve (line 310), compressor bypass valve (line 320), intake manifold throttle (line 330), ES speed (line 340), and fuel injection (last plot in FIG. 3) during engine cold start according to method 200. FIG. 3 also shows how engine parameters such as intake manifold pressure (line 350), intake manifold temperature (line 360), and engine speed (line 370) change over time in response to the operations.

The x-axis of the plots in FIG. 3 demonstrates time, and the time increases from left to right as indicated by the arrows. Before time $T_0$, the engine is shut down and engine speed is zero. There is no operation of the ES bypass valve, compressor bypass valve, intake manifold throttle, or ES.

Upon receiving an engine start request at time $T_0$, a controller (such as controller 12 in FIG. 1) determines that the engine is under cold start. In response to determining the engine is under cold start, at $T_0$, the controller closes the ES bypass valve, opens the compressor bypass valve, opens the intake manifold throttle, and starts operating the ES in a forward direction to compress air and increase the manifold charge pressure downstream of the ES output and upstream of the intake manifold throttle.

From $T_0$ to $T_1$, intake manifold pressure 350 increases to level 353. With increased intake manifold pressure, intake manifold temperature 360 increases to level 361 due to heat conducted from the compressed air. FIG. 3 shows an embodiment wherein the ES is operated for a predetermined duration from $T_0$ to $T_1$. In another embodiment, the ES may be operated until a predetermined intake manifold pressure level (such as level 353) is reached. In yet another embodiment, ES may be operated until a predetermined intake manifold temperature (such as level 361) is reached.

Once the ES stops compressing air at time $T_1$, the controller opens the ES bypass valve to release the compressed air from the intake manifold. In an example, the ES bypass valve may be fully opened. In another example, the degree of the opening of the ES bypass valve may be controlled by the controller. With the compressed air being released, intake manifold pressure decreases after $T_1$ to a target pressure level 352. The target pressure level 352 may be atmospheric pressure. The target pressure level 352 may alternatively be a pressure level determined by engine operating conditions.

In another embodiment, starting from $T_1$, the controller may operate the ES to run in reverse for a predetermined time period from $T_1$ to $T_2$, as shown in dashed line 341. Alternatively, the controller may operate the ES to run in reverse until intake manifold pressure decreases to a target pressure level 352. Reversing the ES enables faster release of the compressed air. As shown in dashed line 351, manifold charge pressure may reach the target pressure level faster comparing to only operating the ES bypass valve (such as line 350). In another example, besides operating the ES in reverse, the opening of the ES valve may also be increased to facilitate reducing the manifold pressure to the target pressure level.

At time $T_3$, when intake manifold pressure reaches the target pressure level, the controller closes the compressor bypass valve, opens the ES bypass valve, and starts injecting fuel into a cylinder for a first combustion (as shown in 381). The controller may also decrease the opening of the intake manifold throttle as shown in 330. Based on the intake manifold temperature, the controller determines engine operating parameters such as cylinder number for the first combustion, fuel amount, fuel injection timing, air charge, and spark timing. As another example, the engine operating parameters may be determined based on a change of intake manifold temperature from $T_0$ to $T_3$. Upon initiating combustion at $T_3$, engine speed 370 increases over time.

In this way, the intake manifold is warmed up by air compressed by an electric supercharger before fuel injection. During cold start, fuel with ultra-low volatility may be warmed up when injected into the intake manifold. Thus, fuel enters the combustion chamber in gaseous form to ensure the initiation of a first combustion. Due to the fast response time and the high efficiency of the electric supercharger, the intake manifold may be warmed up quickly. Moreover, the disclosed method further adjusts an intake manifold pressure to a target value before fuel injection. As such, engine operating parameters may be optimized for the initial combustions. Engine operating parameters may further be optimized based on intake manifold temperature.

The technical effect of operating an electrical supercharger before a first combustion during cold start is that intake manifold may be warmed up without extra equipment specially designed for cold start. Heat from the warmed up intake manifold may prevent fuel injected into the combustion chamber being in liquid form. The technical effect of adjusting the intake manifold pressure to a target pressure is that engine operating parameters may be optimized to improve the efficiency and emission of the engine during cold start.

A method for an engine includes in response to an engine start request, operating a supercharger to warm up an intake manifold; and adjusting an intake manifold pressure before starting a first combustion of the engine. In a first example of the method, adjusting intake manifold pressure includes bypassing the supercharger by increasing an opening of a valve coupled between an output and an input of the supercharger, wherein the supercharger is stopped before opening the valve. A second example of the method optionally includes the first example and further includes adjusting intake manifold pressure includes operating the supercharger in a reverse direction to reduce the intake manifold charge pressure. A third example of the method optionally includes one or more or each of the first example and second example, and further includes wherein the intake manifold pressure is adjusted after operating the supercharger for a pre-determined time period. A fourth example of the method optionally includes one or more or each of the first through third examples, and further includes wherein the intake manifold pressure is adjusted when the intake manifold temperature reaches a pre-determined threshold. A fifth example of the method optionally includes one or more or each of the first through fourth examples, and further includes wherein the intake manifold pressure is adjusted when the intake manifold pressure reaches a pre-determined threshold. A sixth example of the method optionally includes one or more of each of the first through fifth examples, and further includes wherein the first combustion of the engine is started when the intake manifold pressure reaches an atmospheric pressure. A seventh example of the method optionally includes one or more of each of the first through sixth examples, and further includes wherein the first combustion of the engine is started when the intake manifold pressure reaches a target level based on engine operating conditions. An eighth example of the method optionally includes one or more or each of the first through seventh examples, and further includes wherein the supercharger is an electric supercharger.

An engine method for starting the engine includes in response to an engine start request, in a first mode, starting a first combustion of the engine; and in a second mode, before the first combustion of the engine, closing a supercharger bypassing valve; operating a supercharger to warm up an intake manifold; and adjusting an intake manifold pressure. In a first example of the method, the method further includes opening an intake manifold throttle while warming up the intake manifold. A second example of the method optionally includes the first example and further includes adjusting intake manifold pressure by increasing the opening of the supercharger bypassing valve. A third example of the method optionally includes one or more or each of the first example and second example and further includes adjusting intake manifold pressure by operating the supercharger in a reverse direction. A fourth example of the method optionally includes one or more of each of the first through third examples, and further includes, adjusting engine operating parameters based on a change of the intake manifold temperature before starting the first combustion of the engine, wherein the engine operating parameters comprise one or more of fuel amount, fuel injection timing, air charge, spark timing, and cylinder number for the first combustion.

An engine system includes an intake manifold; an intake manifold throttle coupled to the intake manifold; an electric supercharger; a first valve bypassing the electric supercharger; a turbocharger with a compressor positioned upstream of the electric supercharger; a second valve bypassing the compressor; and a controller configured with computer readable instructions stored on non-transitory memory for: in a first mode, starting a first combustion of the engine in response to an engine start request; and in a second mode, postponing the first combustion of the engine in response to the engine start request. The postponing includes closing the first valve; opening the second valve; opening the intake manifold throttle; operating the electric supercharger in a forward direction to warm up the intake manifold; adjusting intake manifold pressure; closing the second valve; adjusting engine operation parameters based on intake manifold temperature; and starting the first combustion of the engine. In one example, adjusting engine operation parameters based on intake manifold temperature includes setting one or more combustion parameters, such as fuel injection timing, fuel injection amount, spark timing, etc., based on the intake manifold temperature, and starting the first combustion of the engine includes performing combustion in a first cylinder of the engine according to the set combustion parameters.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

in response to an engine start request, operating a supercharger to warm up an intake manifold; and adjusting an intake manifold pressure before starting a first combustion of the engine, wherein the intake manifold pressure is adjusted when the intake manifold pressure reaches a pre-determined threshold.

2. The method of claim 1, wherein adjusting the intake manifold pressure includes bypassing the supercharger.

3. The method of claim 2, wherein the supercharger is bypassed by increasing an opening of a valve coupled between an output and an input of the supercharger.

4. The method of claim 3, wherein the supercharger is stopped before opening the valve.

5. The method of claim 1, wherein the intake manifold pressure is adjusted after operating the supercharger for a pre-determined time period.

6. The method of claim 1, wherein the intake manifold pressure is adjusted when an intake manifold temperature reaches a pre-determined threshold.

7. The method of claim 1, wherein adjusting the intake manifold pressure includes operating the supercharger in a reverse direction to reduce an intake manifold charge pressure.

8. The method of claim 1, wherein the first combustion of the engine is started when the intake manifold pressure reaches a target level.

9. The method of claim 8, wherein the target level is atmospheric pressure.

10. The method of claim 8, wherein the target level is determined based on engine operating conditions.

11. The method of claim 1, further comprising adjusting engine operating parameters based on an intake manifold temperature before starting the first combustion of the engine.

12. The method of claim 1, wherein the supercharger is an electric supercharger.

13. A method for starting an engine, comprising:
in response to an engine start request,
in a first mode, starting a first combustion of the engine; and
in a second mode, before the first combustion of the engine,
closing a supercharger bypassing valve;
operating a supercharger to warm up an intake manifold; and
adjusting an intake manifold pressure when the intake manifold pressure reaches a pre-determined threshold.

14. The method of claim 13, further comprising opening an intake manifold throttle while warming up the intake manifold.

15. The method of claim 13, wherein adjusting the intake manifold pressure includes increasing an opening of the supercharger bypassing valve.

16. The method of claim 13, wherein adjusting the intake manifold pressure includes operating the supercharger in a reverse direction.

17. The method of claim 13, further comprising adjusting engine operating parameters based on a change of an intake manifold temperature before starting the first combustion of the engine.

18. The method of claim 17, wherein the engine operating parameters comprise one or more of fuel amount, fuel injection timing, air charge, spark timing, and cylinder number for the first combustion.

19. An engine system, comprising:
an intake manifold;
an intake manifold throttle coupled to the intake manifold;
an electric supercharger;
a first valve bypassing the electric supercharger;
a turbocharger with a compressor positioned upstream of the electric supercharger;
a second valve bypassing the compressor; and
a controller configured with computer readable instructions stored on non-transitory memory for:
in a first mode, starting a first combustion of an engine in response to an engine start request; and
in a second mode, postponing the first combustion of the engine in response to the engine start request, the postponing comprising:
closing the first valve;
opening the second valve;
opening the intake manifold throttle;
operating the electric supercharger in a forward direction to warm up the intake manifold after closing the first valve, and after opening the second valve and the intake manifold throttle;
adjusting intake manifold pressure after operating the electric supercharger in the forward direction;
closing the second valve after adjusting the intake manifold pressure;
adjusting engine operation parameters based on an intake manifold temperature after closing the second valve; and
starting the first combustion of the engine with the adjusted engine operation parameters.

* * * * *